US005176286A

United States Patent [19]

Snowdon

[11] Patent Number: 5,176,286

[45] Date of Patent: Jan. 5, 1993

[54] BAG DISPENSER

[75] Inventor: Michael Snowdon, Demossville, Ky.

[73] Assignee: Equitable Bag Co., Inc., Long Island City, N.Y.

[21] Appl. No.: 747,684

[22] Filed: Aug. 20, 1991

[51] Int. Cl.[5] ..... B65H 1/04

[52] U.S. Cl. ..... 221/45; 221/283; 221/305; 248/229

[58] Field of Search ..... 221/33, 45, 46, 47, 221/64, 283, 305; 248/229

[56] References Cited

U.S. PATENT DOCUMENTS

| | | | |
|---|---|---|---|
| 2,036,655 | 4/1936 | Storaasli | 248/229 |
| 2,063,924 | 12/1936 | Hanko | 248/229 |
| 2,256,638 | 9/1941 | Blakeney | 221/305 X |
| 2,263,956 | 11/1941 | Russell | 221/46 |
| 2,279,658 | 4/1942 | Crebbs | 221/45 |
| 2,472,183 | 6/1949 | Williamson | 221/305 X |
| 2,574,345 | 11/1951 | Montgomery | 221/47 |
| 2,666,612 | 1/1954 | Howell | 248/229 X |
| 2,804,236 | 8/1957 | Piazze | 221/64 |

*Primary Examiner*—D. Glenn Dayoan
*Assistant Examiner*—Dean A. Reichard
*Attorney, Agent, or Firm*—Brumbaugh, Graves, Donohue & Raymond

[57] ABSTRACT

A bag dispenser for a plurality of bags in which the bags are retained on a tray which has an apertured, fold-back flap at one end. The tray, the bag pack and the fold-back flap are enclosed within an overwrap. When the portion of the overwrap covering the aperture is removed, bags can be dispensed one at a time through the aperture.

6 Claims, 2 Drawing Sheets

BAG DISPENSER

This invention relates to a bag dispenser for a pack of plastic bags from which the bags can be dispensed one at a time through an aperture in the end of the dispenser.

BACKGROUND OF THE INVENTION

Plastic bags shipped in flexible packs are difficult to dispense one at a time. They tend to semi-adhere together so that when an effort is made to remove the top bag in the pack from top or side openings, one or more of the underneath bags tend to accompany the top bag, requiring the underneath bags to be reoriented in the pack when the top bag is separated.

Plastic bag packs are also supplied in rigid corrugated boxes which are opened at the top or at one end. It is, however, difficult to grasp the uppermost bag in the box and remove it from the box without causing one or more of the underneath bags to be grasped or moved forwardly, so that when the upper bag is separated it is necessary to move one or more underneath bags back into the box.

The dispensing of single plastic bags from a bag pack is often not possible, causing frustration and wastage of both time and product.

SUMMARY OF THE INVENTION

The present invention relates to an improved bag package and dispenser that is economical, facilitates handling and packaging of a bag pack, is suitable for under-the-counter or on-shelf loading, allows for quick and easy opening and permits dispensing of a single bag at a time while retaining the product covered within the package enclosure, thereby maintaining the bags in orderly and clean condition.

The bag dispenser includes a stiff tray having upwardly extending side walls for receiving a pack of bags, a stiff fold-back retainer flap connected at one end of the tray between the side walls, the flap extending upwardly and rearwardly to overlie the bags on the tray and to retain the bags on the tray and an aperture in the retainer flap to facilitate the removal of the uppermost bag through the aperture.

The tray with the bags thereon and the flap folded back at one end of the tray are enclosed within a flexible overwrap which preferably has means thereon delineating the portion of the overwrap overlying the aperture. The delineating means is preferably a weakened line to facilitate the opening of the portion of the overwrap overlying the aperture. In this way, the tray, the bag pack and the fold-back retainer flap are enclosed within the overwrap, keeping the bags clean and in stacked relationship within the enclosure, while the bags are removed from the exposed aperture one at a time.

The tray and fold-back retainer flap within the overwrap provide reinforcement for the package, preventing the overwrap from ripping, spreading and relaxing as the package volume decreases while preventing shifting and forward movement of the underlying bags when the uppermost bag of the pack is removed in a forward sliding motion.

DESCRIPTION OF THE DRAWINGS

For a complete understanding of the present invention, reference should be made to the detailed description which follows and to the accompanying drawing in which.

DESCRIPTION OF PREFERRED EMBODIMENT

Figure 1:
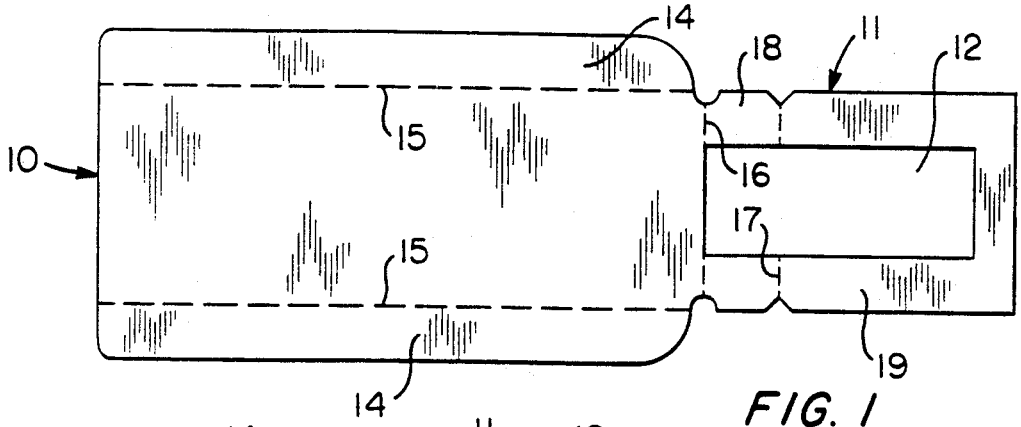
FIG. 1 is a plan view of a tray and fold-back retainer flap used in the bag dispenser of the present invention.
Figure 2:
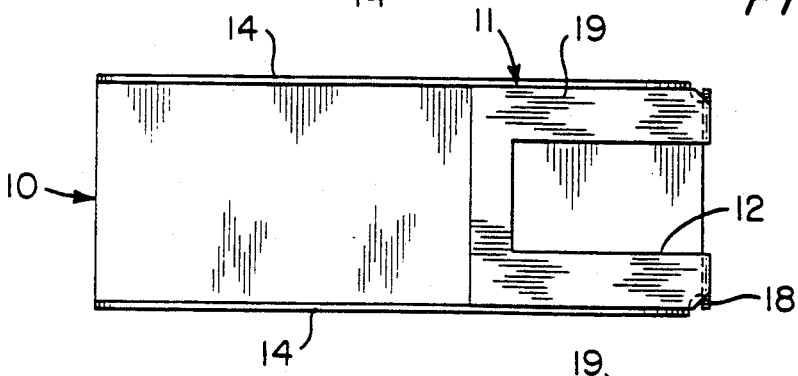
FIG. 2 is a view similar to FIG. 1 with the side walls of the tray folded upwardly and the fold-back flap folded upwardly at one end of the tray and then folded back over the tray.
Figure 3:
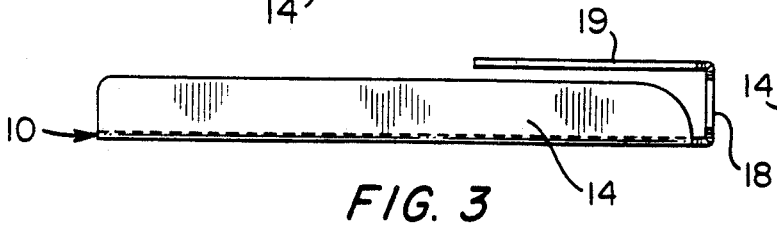
FIG. 3 is a side elevation of the tray and fold-back flap shown in FIG. 2.
Figure 4:
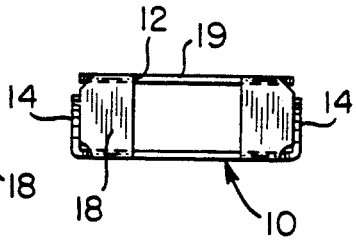
FIG. 4 is a front elevation of the arrangement shown in FIGS. 2 and 3.
Figure 5:
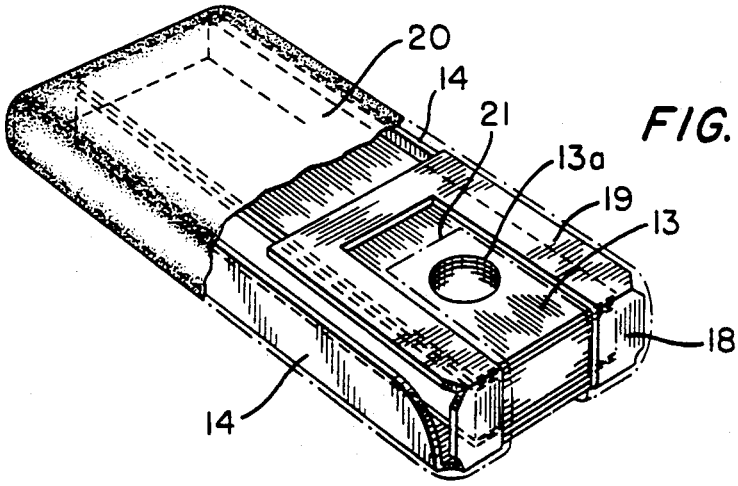
FIG. 5 is a perspective view of the tray accommodating a bag pack and enclosed within a flexible overwrap, the overwrap being broken away at one end.
Figure 6:
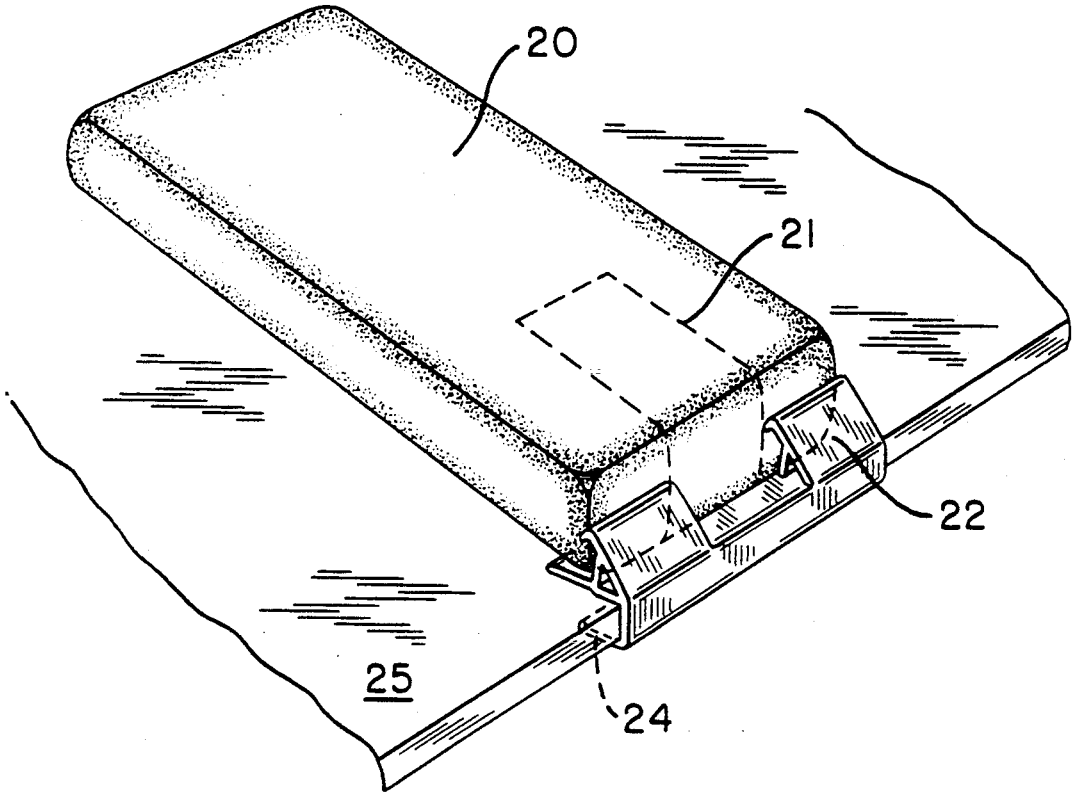
FIG. 6 is a perspective view of the package retained on a shelf by retainer clip.
Figure 7:
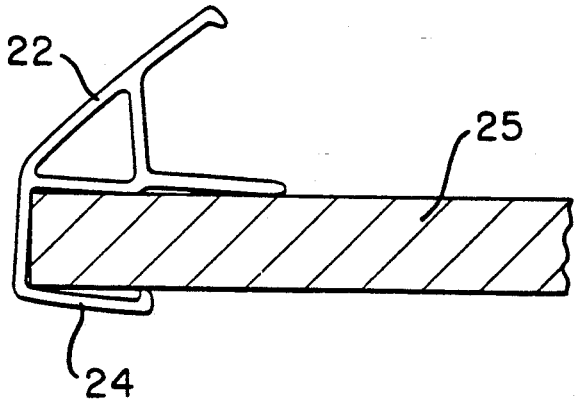
FIG. 7 is an end view of the retainer clip.

The bag dispenser of the present invention includes a tray 10, a fold-back flap 11 at one end of the tray and an aperture 12 formed in the fold-back flap. The tray and fold-back flap are preferably made integrally of a relatively stiff material, such as corrugated paperboard.

In use the tray accommodates a plurality of plastic bags 13 between upwardly extending side walls 14 defined by parallel, longitudinally extending fold lines 15. The fold-back flap has a pair of parallel, transversely extending fold lines 16, 17 to subdivide the fold-back flap into an upstanding front wall 18 and rearwardly extending flap 19 which overlies the bags on the tray. The bags are shown with hand holes 13*a*. The tray, bag pack and fold-back flap are enclosed within a flexible overwrap 20.

The stiff tray and fold-back flap provide a relatively rigid retainer for the bag pack so that the pack is maintained intact during handling and dispensing. The flexible overwrap maintains the tray and fold-back flap in proper folded condition to retain the bag pack while providing a covered enclosure for the bags.

The flexible overwrap has means 21 thereon delineating the portion of the overwrap overlying the aperture, preferably a weakened line which permits that portion of the overwrap to be removed to expose the aperture 12. A bag retainer 22 anchored to the end of a shelf 25 by a clip 24 can be used as a stop or retainer to resist the movement of the bag dispenser upon the removal of the top bag in the pack. The retainer 22 is adapted to engage the bag dispenser on opposite sides of the aperture 12 so as not to interfere with the removal of bags from the bag pack.

The invention has been shown in a single preferred form and by way of example only, and various modifications and variations may be made therein within the scope of the invention. The invention therefore is not to be limited to any particular form or embodiment, except insofar as such limitations are expressly set forth in the claims.

I claim:

1. A bag dispenser comprising a stiff open tray having upwardly foldable side walls for receiving a stack of plastic merchandising bags, a stiff fold-back retainer flag connected integrally to the tray at one end of the tray between the side walls, said flap folding upwardly at one end of and then folding rearwardly to overlie the portion of the stack adjacent the end of the tray to which the fold-back retainer flap is integrally connected and retain the bags on the tray, the area of the rearwardly extending portion of the flap being small in relation to the area of the tray and having a length substantially less than the end to end length of the tray and an aperture in the upwardly and rearwardly extending portions of the flap to facilitate removal of the uppermost bag in the stack.

2. A bag dispenser as set forth in claim 1 in which the tray and retainer flap are formed integrally in a sheet having parallel, longitudinal fold lines in the sheet defining the fold-up side walls, the flap being no wider than the distance between the longitudinal fold lines defining the fold-up side walls, and parallel transverse fold lines in the sheet defining a fold-up front wall and a fold-back top wall.

3. A bag disperser as set forth in claim 2 including a flexible overwrap for the tray and fold-back flap retaining a stack of bags, said overwrap retaining the flap is folded-back position when bags are removed from the dispenser through the aperture in the fold-back flap and an opening made in the overwrap to provide access to the aperture.

4. A bag dispenser as set forth in claim 1 including a flexible overwrap for the tray and fold-back flap retaining a plurality of bags and means delineating the portion of the overwrap overlying the aperture.

5. A bag dispenser as set forth in claim 4 in which said delineating means is a weakened line to facilitate removal of the portion of the overwrap overlying the aperture.

6. A bag dispenser as set forth in claim 1 including a clip engageable with the edge of a shelf and upwardly extending retainer walls engageable with the front end of the bag dispenser on opposite sides of the aperture.

* * * * *

UNITED STATES PATENT AND TRADEMARK OFFICE

CERTIFICATE OF CORRECTION

PATENT NO. : 5,176,286

DATED : Jan. 5, 1993

INVENTOR(S) : Snowdon

It is certified that error appears in the above-identified patent and that said Letters Patent is hereby corrected as shown below:

Col. 3, line 16, "flap is" should read --flap in--.

Signed and Sealed this

Sixteenth Day of November, 1993

Attest:

Bruce Lehman

BRUCE LEHMAN

Attesting Officer

Commissioner of Patents and Trademarks